US006499274B1

(12) United States Patent
McDonald et al.

(10) Patent No.: US 6,499,274 B1
(45) Date of Patent: Dec. 31, 2002

(54) METHOD FOR HIGH SPEED LOADING, VACUUMIZING AND SEALING OF A BAGGED ARTICLE

(75) Inventors: Gregory E. McDonald, Simpsonville, SC (US); Jeffrey L. Walker, Easley, SC (US); Glenn W. Killinger, Simpsonville, SC (US); Andrew W. Moehlenbrock, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 126 days.

(21) Appl. No.: 09/597,680

(22) Filed: Jun. 20, 2000

(51) Int. Cl.[7] ..... B65B 31/00

(52) U.S. Cl. ..... 53/434; 53/512; 53/251; 198/867.15; 198/803.2; 198/465.1; 198/465.3

(58) Field of Search ..... 53/512, 434, 251; 198/867.15, 803.2, 465.3, 465.1

(56) References Cited

U.S. PATENT DOCUMENTS

| | | | | |
|---|---|---|---|---|
| 3,958,391 A | | 5/1976 | Kujubu | 53/22 B |
| 4,550,548 A | * | 11/1985 | Owensby et al. | 53/434 |
| 4,640,081 A | * | 2/1987 | Kawaguchi et al. | 198/463.3 |
| 4,843,796 A | * | 7/1989 | Furukawa | 53/434 |
| 5,062,252 A | * | 11/1991 | Kupcikevicius | 53/434 |
| 5,209,043 A | * | 5/1993 | Kupcikevicius | 53/434 |
| 5,435,114 A | | 7/1995 | Moehlenbrock et al. | 53/434 |
| 5,463,844 A | | 11/1995 | Moehlenbrock et al. | 53/436 |
| 5,692,360 A | | 12/1997 | McDonald et al. | 53/434 |

FOREIGN PATENT DOCUMENTS

| | | |
|---|---|---|
| WO | WO 97/16347 | 5/1997 |

* cited by examiner

*Primary Examiner*—Rinaldi I. Rada
*Assistant Examiner*—Thanh Truong
(74) *Attorney, Agent, or Firm*—Mark B. Quatt

(57) ABSTRACT

The present invention relates to a method, apparatus, and system for loading, vacuumizing, and sealing bagged articles. The invention includes placing a bagged article onto a subplaten, and advancing the loaded subplaten through a synchronizing assembly which allows synchronized placement of the loaded subplaten onto the platen of a vacuum/seal apparatus. The invention provides improved automation of the entire loading/vacuumizing/sealing process for a wide variety of bagged articles, especially food articles such as meat, poultry, cheese, and the like.

10 Claims, 6 Drawing Sheets

METHOD FOR HIGH SPEED LOADING, VACUUMIZING AND SEALING OF A BAGGED ARTICLE

FIELD OF THE INVENTION

The present invention relates to a system and a method for packaging articles, particularly food articles such as poultry, cheese, fresh red meat, and smoked and processed meat.

BACKGROUND OF THE INVENTION

Vacuum packaging in heat sealable plastic bags is a conventional way of packaging food items such as poultry, meat, and cheese. Vacuum packaging typically involves placing the food item in a heat sealable plastic bag and then evacuating air from the bag and thus collapsing it about the contained food item. The bag is then heat sealed in its evacuated condition so the food item becomes encased in a generally air-free environment. Typically, the bag is a heat shrinkable bag, and after the heat sealing step, is advanced to a hot water or hot air shrink tunnel to induce shrinkage of the bag around the food item.

Currently the process of vacuumizing and sealing is often accomplished by placing bagged articles on the platens of a rotary chamber machine. Rotary chamber machines are well known in the art. Typical are the packaging machine and machine systems developed by Furukawa Manufacturing Co., Ltd., and disclosed in U.S. Pat. No. 3,958,391 (Kujubu), U.S. Pat. No. 4,580,393 (Furukawa), and 4,640,081 (Kawaguchi et al.), all incorporated herein by reference in their entirety. Current rotary chamber systems have designed in labor to load bagged articles onto platens. This is in part due to the inability to automate the process, in part due to the flexible nature of bagged food articles and the range of variation associated with bagged articles presented to the rotary chamber system.

Some success has been achieved in staging bagged articles in approximate synchronization using dual infeed systems developed by the Cryovac Division of Sealed Air Corporation. However, actual transfer of bagged articles onto platens of a vacuum/seal apparatus must still be performed manually. In many cases, to achieve full. utilization of the rotary chamber system's capability, multiple operators are required.

Also, to facilitate heat sealing of the bag neck of each bagged article, the human operator routinely straightens each bag neck to eliminate wrinkles. At present, typical bag loading/sealing/vacuumizing operations include a station at which an operator must manually straighten the bag neck before the loading bag is advanced to a vacuumizing/sealing operation. This procedure is thus prone to human error, and can result in considerable variability in the degree to which the bag neck is undesirably wrinkled prior to sealing.

Additionally, the more a food article or bag containing the article is handled manually, the greater the possibility of microbial contamination.

Thus, despite the existence of these packaging machines and systems, there remains a need for a fully automated food packaging system. There also remains a need for a food packaging system which is not labor intensive, which avoids the need for an operator to manually straighten the bag neck before the loading bag is advanced to a vacuumizing/sealing operation, and which minimizes manual handling of the bagged article.

Current rotary chamber systems have proven to be very reliable and efficient at vacuumizing and sealing bagged food articles. Flexibility remains an important feature of these systems, which frequently handle different articles simultaneously with no change over or interruption in machine operation. It is therefore desirable, in developing a fully automated food packaging system, to maintain the flexibility of the rotary chamber/bag system while eliminating or at least reducing the amount of labor needed to load the system.

SUMMARY OF THE INVENTION

In a first aspect, an apparatus comprises a plurality of subplatens each capable of carrying a bagged article, the subplatens each comprising a carrying portion having a top and bottom, a side groove disposed along at least one side of the carrying portion, a bottom groove disposed on the bottom of the carrying portion, and a clamp anvil disposed on the bottom of the carrying portion; a conveyor for advancing the subplatens from a loading station toward a vacuum/seal apparatus, the vacuum/seal apparatus having a plurality of platens capable of moving in a circuit; and a synchronizing assembly capable of loading each subplaten onto a platen of the vacuum/seal apparatus, the synchronizing assembly comprising an endless chain assembly, the chain assembly having a chain capable of being rotated about two spaced apart axes, a plurality of lugs disposed in spaced apart arrangement along the chain; a queuing device disposed near an upstream end of the chain assembly; and a locking pin disposed in an upper surface of at least one platen of the vacuum/seal apparatus.

In a second aspect, a method comprises placing a bagged article on a subplaten, the subplaten comprising a carrying portion having a top and bottom, a side groove disposed along at least one side of the carrying portion, a bottom groove disposed on the bottom of the carrying portion, and a clamp anvil disposed on the bottom of the carrying portion; advancing the subplaten from a loading station toward a vacuum/seal apparatus, the vacuum/seal apparatus having a plurality of platens capable of moving in a circuit; and loading the subplaten, with the bagged article placed thereon, onto a platen of the vacuum/seal apparatus.

In a third aspect, an automated system comprises an apparatus for placing a bagged article onto a subplaten; an apparatus capable of advancing the subplaten, with the bagged product placed thereon, from a loading station toward a platen of a vacuum/seal apparatus; an apparatus capable of loading the subplaten, with the bagged product placed thereon, onto a platen of a vacuum/seal apparatus; and a vacuum/seal apparatus for vacuumizing and sealing the bagged article.

In a fourth aspect, a method comprises placing a bagged article onto a subplaten; advancing the subplaten, with the bagged product placed thereon, toward a platen of a vacuum/seal apparatus; loading the subplaten, with the bagged product placed thereon, onto a platen of a vacuum/seal apparatus; and vacuumizing and sealing the bagged article.

Other details, objects and advantages of the system and the method of the present invention are set forth in the following description and drawings wherein like reference numerals depict like elements.

BRIEF DESCRIPTION OF THE DRAWINGS

The invention can be further understood by reference to the attached drawings depicting various embodiments and elements of the present invention, presented for illustrative purposes, wherein.

DESCRIPTION OF THE PREFERRED EMBODIMENT(S)

The invention provides a method and apparatus for mechanically handling a plurality of bagged articles by providing a plurality of subplatens with a uniform geometry that may be mechanically manipulated to convey bagged articles placed on the subplatens; load the subplatens, each carrying a bagged article, onto respective platens of a vacuum/seal apparatus such as a rotary vacuum chamber system; and unload the subplatens, each carrying a bagged article, from the vacuum/seal apparatus after the bagged articles have been vacuumized and heat sealed in the vacuum/seal apparatus.

An automated or manual bag loading system can be used that transfers the bagged article onto a stationary subplaten. The bag neck of the bagged article is preferably clamped to the subplaten. The subplaten, with the bagged article placed thereon, is advanced toward a vacuum/seal apparatus, such as a rotary chamber system. A synchronization assembly automatically loads each subplaten, with, the bagged article placed thereon, onto a platen of the vacuum/seal apparatus. A similar synchronization assembly discharges each subplaten, removes the bagged article (now vacuumized and sealed) from the subplaten, and returns the subplaten to the loading station. Subplaten accumulation, necessary to buffer subplatens between zones of intermittent motion at the bag loaders and zones of continuous motion at the vacuum/seal apparatus, is achieved by incorporating a conveyor, preferably/what is referred to in the art as a power and free conveyor.

Figure 1:
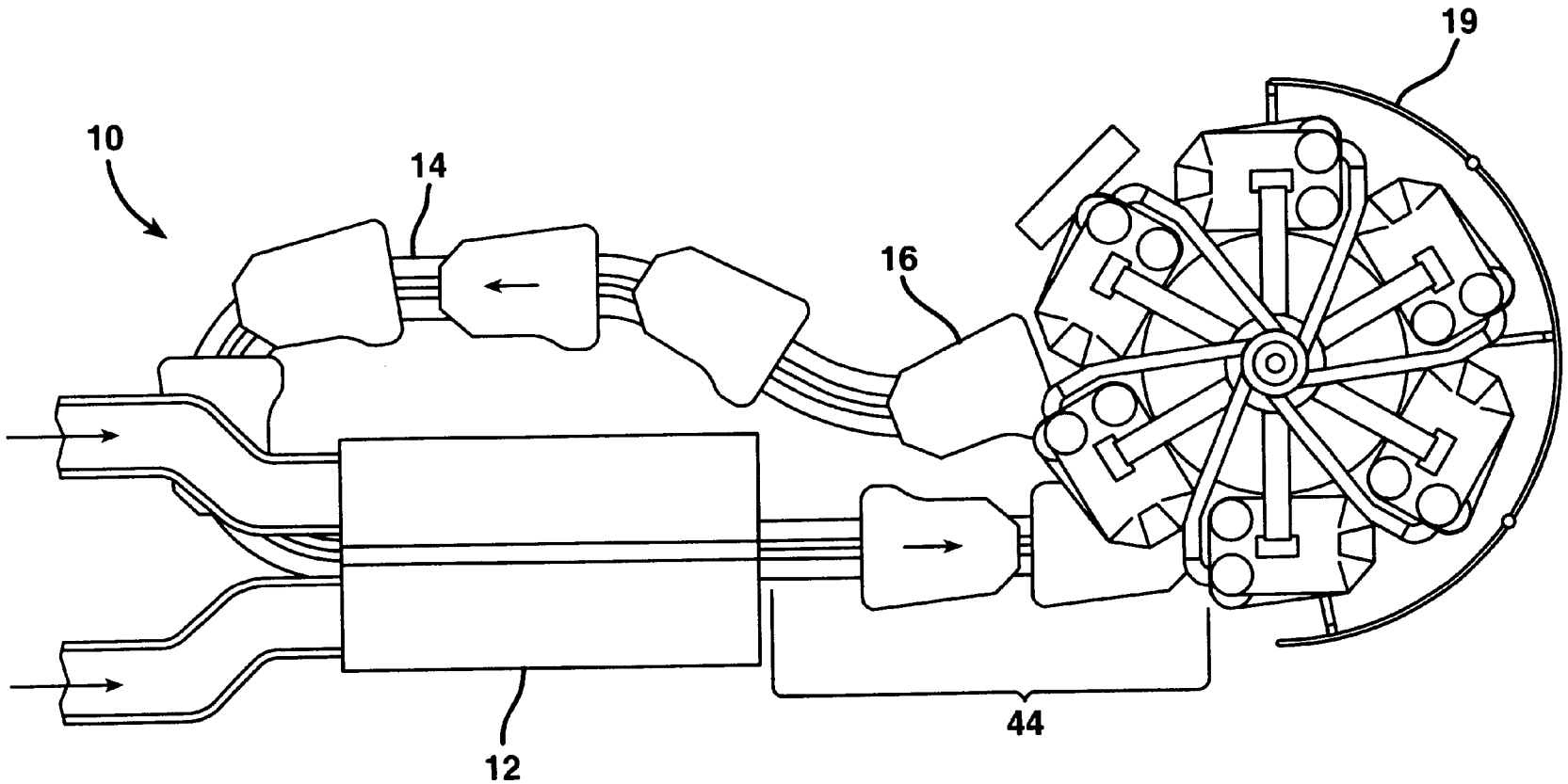
FIG. 1 is a schematic view of an apparatus for loading, vacuumizing and sealing a bagged article.
Figure 5:
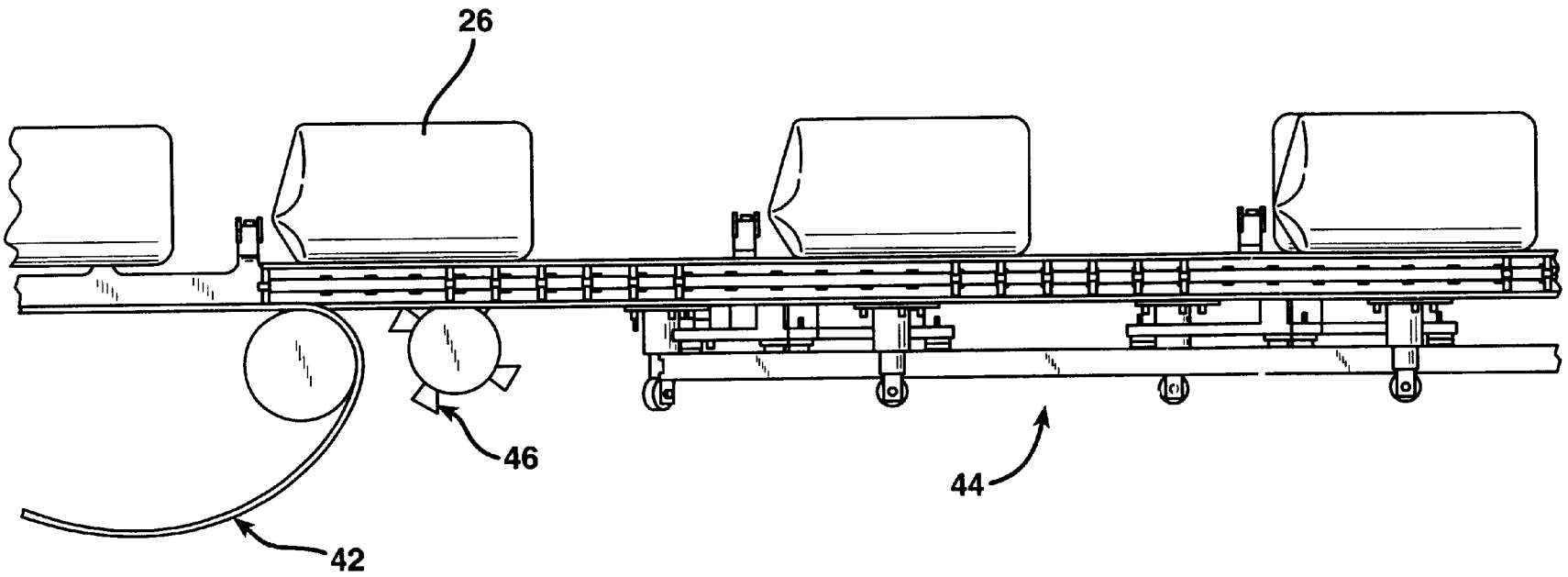
FIG. 5 is a side elevational view of a portion of the synchronizing assembly of FIG. 5.
Figure 6:
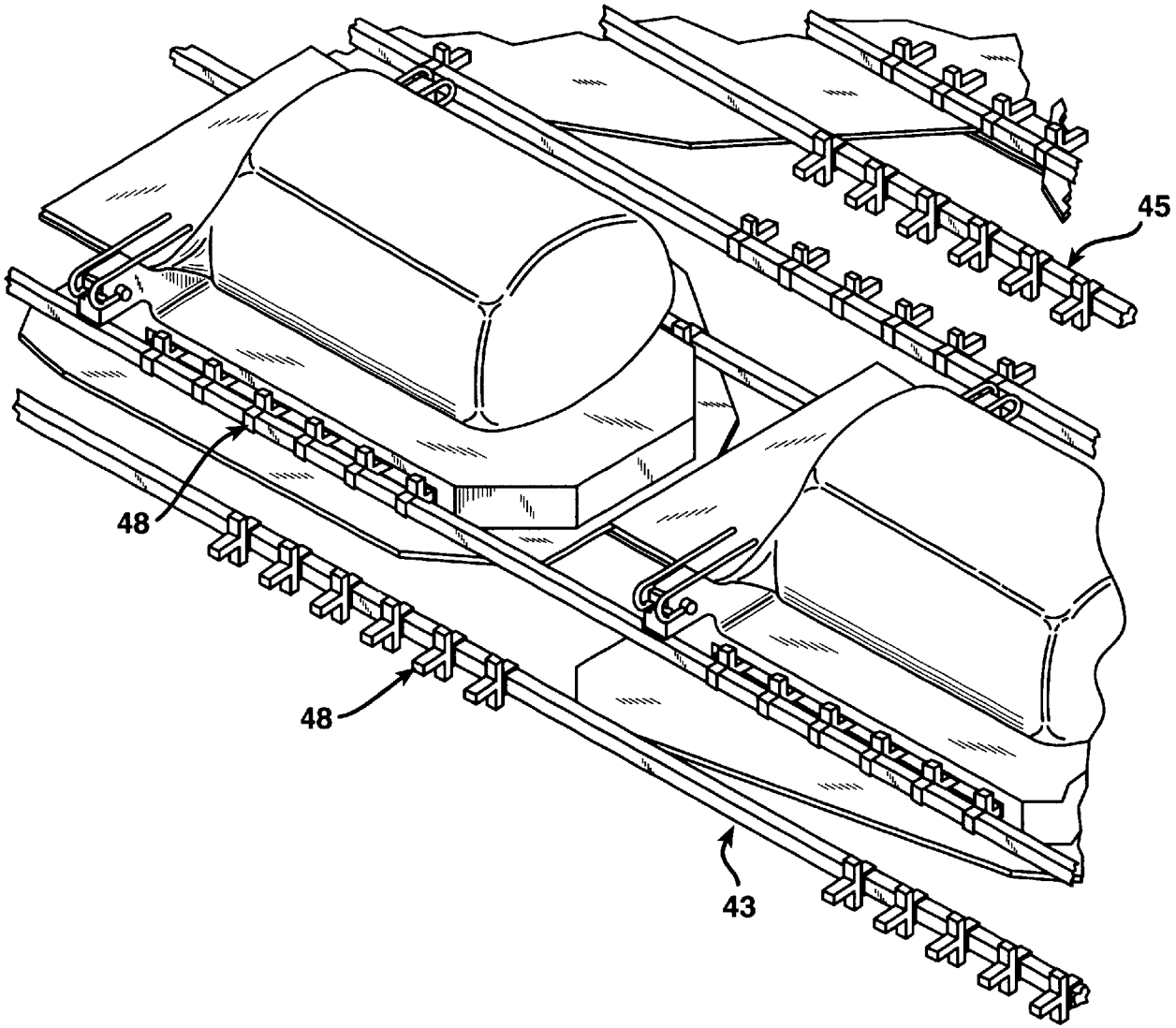
FIG. 6 is an enlarged perspective view of a portion of the synchronizing assembly of FIG. 5.

FIG. 1 shows an apparatus 10 in accordance with the invention. including a bag loading apparatus 12. Bag loading apparatus 12 can be a manual system for placing a bagged article onto a subplaten. Alternatively, bag loading apparatus 12 can be an automated or semi-automated system. Examples include the bag loading apparatus disclosed in U.S. Pat. No. 5,692,360 (McDonald et al.), incorporated herein by reference in its' entirety. A conveyor 14 transports subplatens 16 with loaded, preferably clamped bagged articles 26 (see FIGS. 5 and 6) to a synchronizing assembly [18] 44. The synchronizing assembly acts as a buffer between the bag loading apparatus 12, which typically operates in intermittent motion, and the vacuum/seal apparatus 19. This is especially useful if the vacuum/seal apparatus 19 is a rotary chamber machine (as depicted in FIG. 1), which operates in continuous motion. The advantage here is that the bag loading apparatus 12, if automated, requires no designed-in direct labor, and the bag neck of each bagged article 26 is straightened automatically and clamped to a subplaten 16. Vacuumizing and sealing can thus be done at high speeds on otherwise conventional vacuum/seal apparatus 19.

Figure 2:
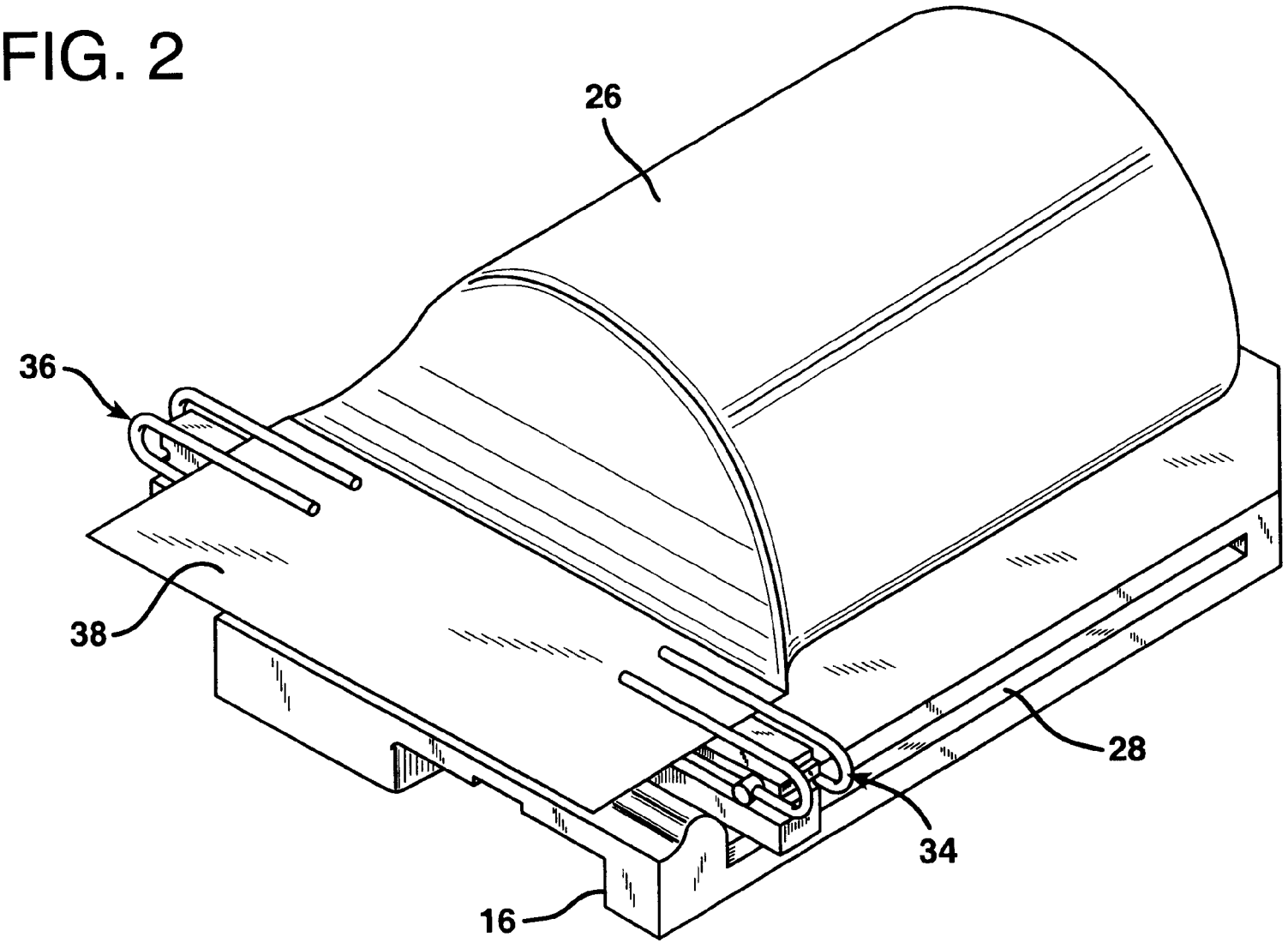
FIG. 2 is a top perspective view of a subplaten with a bagged article placed thereon.

FIG. 2 shows a subplaten 16 with a bagged article 26 placed and clamped thereon, and a side groove 28. Preferably, a side groove is disposed on each of the two opposite sides of each subplaten 16. Thus, FIG. 3 shows a second side groove 29 disposed in the second side of subplaten 16.

Figure 3:
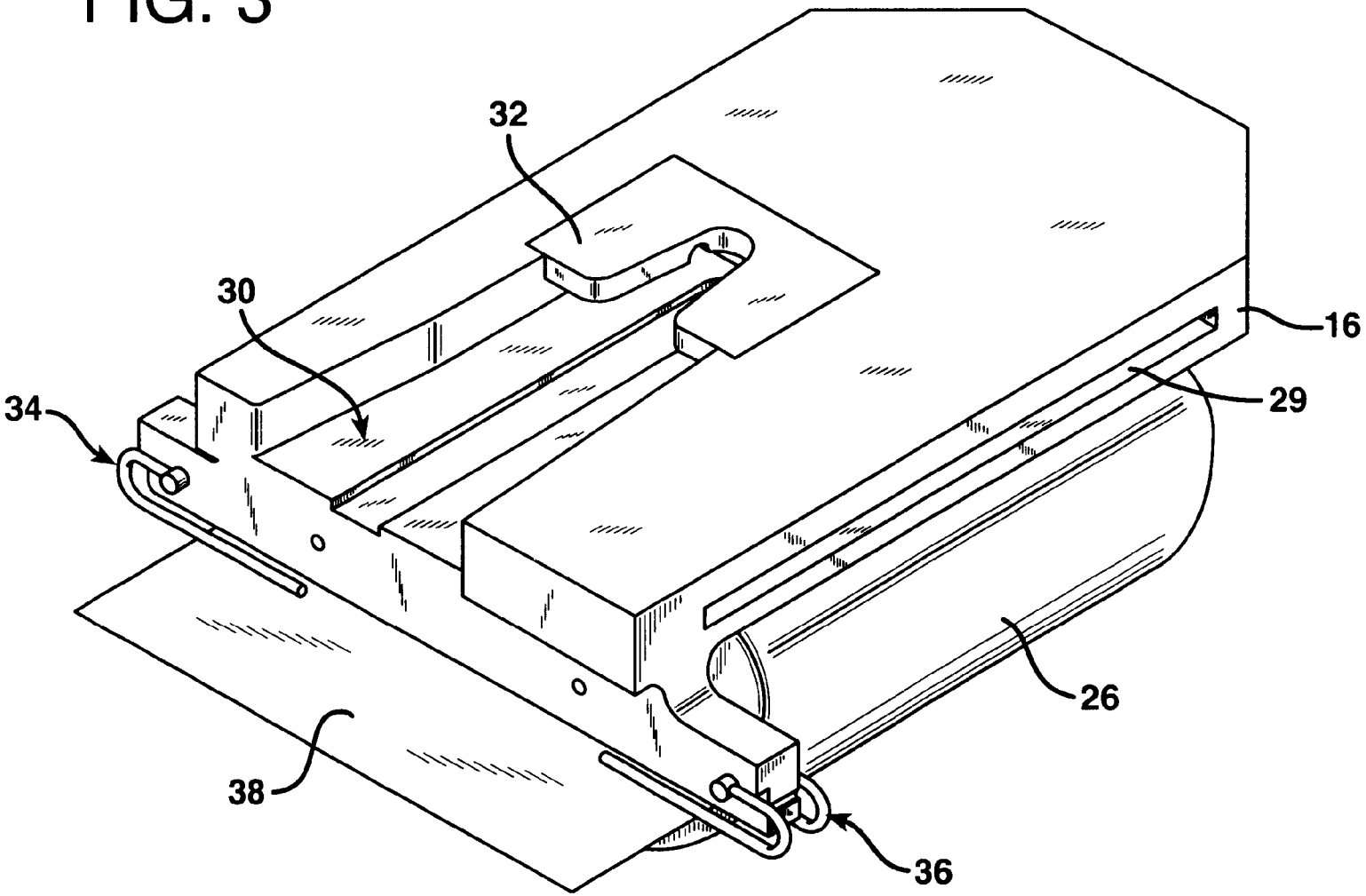
FIG. 3 is a bottom perspective view of the subplaten of FIG. 2.

FIG. 3 shows a bottom view of the subplaten 16, where a bottom groove 30 and subplaten clamp anvil 32 are shown. Preferably incorporated into the subplaten 16 are bag clamps 34 and 36. These bag clamps hold and maintain control of the bag neck 38 of the bagged article 26 during conveying. The invention includes embodiments in which the bag clamps are not present. A contoured top surface of the subplaten 16 can help stabilize the bagged article when placed on the subplaten, especially when the subplaten is advanced as discussed herein. With bagged article 26 secured to the subplaten 16, the bagged article subplaten assembly 40 (including a subplaten 16 and a bagged article 26 placed thereon) is conveyed by conveyor 42 toward the vacuum/seal apparatus 19. As subplatens 16 approach the synchronizing assembly 44, they are momentarily held in the correct position by a queuing device 46, such as a starwheel or the like (see FIG. 5).

Figure 4:
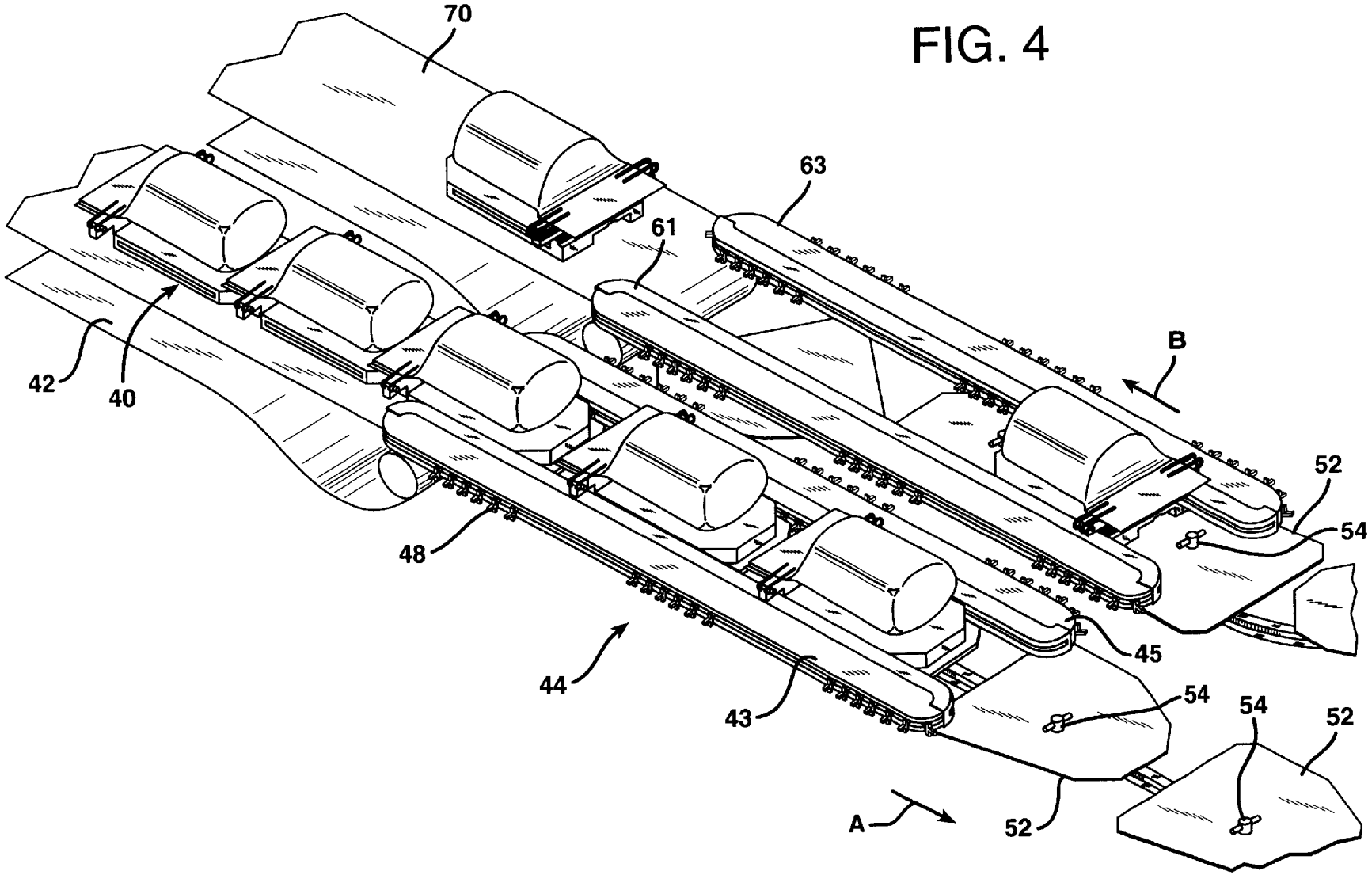
FIG. 4 is a perspective view of a synchronizing assembly.

FIG. 4 shows a synchronizing assembly 44 that includes a first and second endless chain assembly 43 and 45, the first and second chain assemblies disposed in adjacent spaced apart parallel relation to each other, capable of rotation in opposite directions from each other. Thus, in operation, the two endless chain assemblies 43 and 45 will rotate about their respective axes so that lugs 48 engage the subplaten side grooves 28 and 29. The lugs 48 are shown disposed in spaced series along each chain assembly.

The power and free feature of the conveyor 42 allows the subplatens 16 to accumulate at the head of the synchronizing assembly 44. The lugs 48 attached to chain assemblies 43 and 45 (see FIG. 6) rotate continuously as shown. Speed and spacing of the lugs match the speed and spacing of platens 52 of the rotary chamber machine with engagement of the forward most lug against the front of the side grooves operating to advance each subplaten 16 synchronously with a platen 52. As each subplaten advances, the platen clamp 54 mounted on each platen 52 moves vertically upward into a bottom subplaten groove 30, just behind the subplaten clamp anvil 32. Vertical displacement can be effected by any known means, such as a cam (not shown for sake of clarity) positioned beneath the circuit of platens 52.

As each subplaten 16 approaches the downstream end of the synchronizing assembly 44, the lead lug 48 disengages the subplaten side groove causing the subplaten to momentarily decelerate allowing the platen clamp 54 to advance over the clamp anvil 32. Subsequent downward motion of the platen clamp 54, by virtue of its geometry, causes the subplaten 16 to be transferred, positioned and clamped securely to the platen 52. As the subplaten 16 then traverses the chamber portion (not shown) of the rotary chamber system (or other vacuum/seal apparatus), the bagged article is vacuumized, sealed and optionally trimmed by means currently employed with rotary chamber or other vacuum/seal apparatus.

General movement of subplatens 16 toward the vacuum/seal apparatus 19 is in the direction of arrow "A"; general movement of subplatens 16 away from the vacuum/seal apparatus, after the bagged article has been vacuumized and sealed, is in the direction of arrow "B" (see FIG. 4).

FIG. 4 thus shows two pairs of chain assemblies: the first pair constitutes chain assemblies 43 and 45, which serve to advance loaded subplatens 16 toward vacuum/seal apparatus 19; the second pair 61,63 serve to move loaded subplatens out of vacuum/seal apparatus 19 and toward the pack-off conveyor 70. The bagged article, now vacuumized and sealed, can then be removed from each subplaten 16 and stored or distributed as needed.

It should be noted that a single chain assembly could be used to advance the loaded subplatens 16; a pair of chain assemblies is preferred, as this enhances tracking of the platens within the synchronizing assembly.

The subplaten lends itself to performing functions currently performed during vacuumizing and sealing. For instance it may be desired to pre-pierce the bag at a separate station and/or trim and remove scrap. The latter step can extend seal cooling time before trimming, with possible benefit relative to edge tears. Both reduce cycle time. Reallocation of the extra time may possibly benefit sealing and seal cooling. Following vacuumizing and sealing subplatens are removed by reversing the loading described above.

As can be seen from the foregoing description, the method and apparatus is preferably totally automated, thus reducing the number of processing and packaging personnel required to accomplish the packaging of article.

It provides, in addition, a consistent, automated way of smoothing the bag neck before sealing. Reducing the wrinkles in the seal area of each bag improves the quality of the packages, because better seals are made when wrinkles in the bag neck area are reduced prior to sealing.

While the system of the present invention has been described in the context of packaging a poultry article such as whole turkey, it may in fact be used with other articles such as cheese, fresh red meat and smoked and processed. Where the article being packaged does not require the injection of a fluid, the fluid injecting system may be disabled. Similarly, any pop-up timer insertion system may be disabled.

It should also be recognized that the system of the present invention may also be used to package non-food articles.

While the invention has been described in the context of specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

For example, a seal bar can be disposed on a subplaten 16.

What is claimed is:

1. An apparatus comprising:

a) a plurality of subplatens each capable of carrying a bagged article, the subplatens each comprising
  i) a carrying portion having a top and bottom,
  ii) a side groove disposed along at least one side of the carrying portion,
  iii) a bottom groove disposed on the bottom of the carrying portion, and
  iv) a clamp anvil disposed on the bottom of the carrying portion;

b) a conveyor for advancing the subplatens from a loading station toward a vacuum/seal apparatus, the vacuum/seal apparatus having a plurality of platens capable of moving in a circuit; and c) a synchronizing assembly capable of loading each subplaten onto a platen of the vacuum/seal apparatus, the synchronizing assembly comprising:
  i) an endless chain assembly, the chain assembly having a chain capable of being rotated about two spaced apart axes,
  ii) a plurality of lugs disposed in spaced apart arrangement along the chain;
  iii) a queuing device disposed near an upstream end of the chain assembly; and
  iv) a locking pin disposed in an upper surface of at least one platen of the vacuum/seal apparatus.

2. The apparatus of claim 1 wherein the subplatens each comprise a pair of clamps operable to grasp a bagged article and hold the bagged article on the subplaten.

3. The apparatus of claim 2 wherein the subplatens each have a first and second lateral half, the subplatens each comprising a) a first clamp disposed on the first lateral half of the subplaten, and b) a second clamp, discrete from the first clamp, disposed on the second lateral half of the subplaten.

4. The apparatus of claim 1 wherein the subplatens each have a seal seat disposed on a top surface of the carrying portion.

5. The apparatus of claim 1 wherein the synchronizing assembly comprises a first and second endless chain assembly, the first and second chain assemblies disposed in adjacent spaced apart parallel relation to each other, capable of rotation in opposite directions from each other, and positioned such that a subplaten with a bagged article placed thereon can be accommodated and advanced between the first and second chain assembly, and loaded onto a platen of the vacuum/seal apparatus.

6. An automated system comprising:

a) an apparatus for placing a bagged article onto a subplaten;

b) an apparatus capable of advancing the subplaten, with the bagged product placed thereon, from a loading station toward a platen of a vacuum/seal apparatus;

c) an apparatus for loading the subplaten, with the bagged product placed thereon, onto a platen of a vacuum/seal apparatus; and d) a vacuum/seal apparatus for vacuumizing and sealing the bagged article; wherein the subplaten comprises a pair of clamps operable to grasp a bagged article and in hold the bagged article on the subplaten.

7. The automated system of claim 6 wherein the subplaten comprises a first and second lateral half, the subplatens each comprising:

i) a first clamp disposed on the first lateral half of the subplaten, and ii) a second clamp, discrete from the first clamp, disposed on the second lateral half of the subplaten.

8. An automated system comprising:

a) an apparatus for placing a bagged article onto a subplaten;

b) an apparatus capable of advancing the subplaten, with the bagged product placed thereon, from a loading station toward a platen of a vacuum/seal apparatus;

c) an apparatus for loading the subplaten, with the bagged product placed thereon, onto a platen of a vacuum/seal apparatus; and d) a vacuum/seal apparatus for vacuumizing and sealing the bagged article; wherein the subplaten comprises a seal seat disposed on a top surface of the subplaten.

9. An automated system comprising:

a) an apparatus for placing a bagged article onto a subplaten, b) an apparatus capable of advancing the subplaten, with the bagged product placed thereon, from a loading station toward a platen of a vacuum/seal apparatus, wherein the apparatus comprises a first endless chain assembly and a second endless chain assembly, the first and second chain assembly disposed in adjacent spaced apart parallel relation to each other;

c) an apparatus for loading the subplaten, with the bagged product placed thereon, onto a platen of a vacuum/seal apparatus; and d) a vacuum/seal apparatus for vacuumizing and sealing the bagged article.

10. The apparatus of claim 9 wherein the first and second endless chain assembly each comprise a chain capable of being rotated about two spaced apart axes.

* * * * *

UNITED STATES PATENT AND TRADEMARK OFFICE

CERTIFICATE OF CORRECTION

PATENT NO. : 6,499,274 B1
DATED : December 31, 2002
INVENTOR(S) : McDonald et al.

It is certified that error appears in the above-identified patent and that said Letters Patent is hereby corrected as shown below:

Column 6,
Line 36, after the word "and", delete -- in --.

Signed and Sealed this

Twenty-sixth Day of August, 2003

JAMES E. ROGAN
*Director of the United States Patent and Trademark Office*